US005119755A

United States Patent [19]

Beisswanger

[11] Patent Number: 5,119,755

[45] Date of Patent: Jun. 9, 1992

[54] DOCTOR

[75] Inventor: Rudolf Beisswanger, Steinheim, Fed. Rep. of Germany

[73] Assignee: J. M. Voith GmbH, Heidenheim, Fed. Rep. of Germany

[21] Appl. No.: 596,782

[22] Filed: Oct. 12, 1990

[30] Foreign Application Priority Data

Oct. 14, 1989 [DE] Fed. Rep. of Germany ..... 3934418

[51] Int. Cl.[5] ..... B05C 11/02

[52] U.S. Cl. ..... 118/123; 118/126; 118/261

[58] Field of Search ..... 118/261, 123, 126; 15/256.51; 101/350, 157, 162, 425; 100/174; 162/272, 199, 281

[56] References Cited

U.S. PATENT DOCUMENTS 4,870,920 10/1989 Kageyama et al. ..... 118/123

*Primary Examiner*—Michael G. Wityshyn
*Assistant Examiner*—Brenda Lamb
*Attorney, Agent, or Firm*—Baker & Daniels

[57] ABSTRACT

A doctor is provided on a coating device and is fashioned as an oblong doctor bar which from the cross section, transverse to its longitudinal expanse, features an irregular cross section and a coating surface of bow-shaped design which is provided with grooves, as dosing grooves, which extend crosswise or perpendicular to the longitudinal expanse of the bar. The grooves flatten out from their bottom toward the leaving edge of the doctor bar by 10 to 25%, preferably in bow-shaped fashion. Furthermore, they widen in this area making the ribs provided between the grooves disappear. The doctor bar consists preferably of oxide ceramic material, or features on its coating surface a layer from such material.

17 Claims, 1 Drawing Sheet

DOCTOR

BACKGROUND OF THE INVENTION

The invention concerns a doctor for dosing coatings of paper and cardboard webs, the body proper of which doctor, featuring the dosing surface, is fashioned as a bar. The bar has an irregular or cornered cross section, in section perpendicular to the longitudinal expanse of the bar, and with a sharp leaving or tearing edge. The dosing surface of the bar is flat or provided with a rounding so that its distance from the paper or cardboard web in running direction reduces continuously, except maximally for the area on its leaving edge.

Such a doctor is known from the U.S. Pat. No. 4,279,949. This doctor is provided with a bar-shaped doctor body which is pivotably mounted so as to enable an adjustment of the contact pressure of its sharp scraper edge on the leaving end of the doctor body. This doctor body may be provided with a wear-resistant surface, consisting specifically of carbide material. Other such doctors with an irregular cross section and bow-shaped doctor surface, in cross section perpendicular to the longitudinal expanse of the doctor bar, are known from EP-A 0109520 and DE-OS 36 20 374. Here, too, either the doctor surface or the entire doctor bar may consist of ceramic, specifically oxide ceramic material because it is especially wear-resistant.

The doctors known from the two formal publications were based on the concept that by means of a sharp, abrupt leaving edge on the end of the doctor surface of the doctor bar it would be possible to assure the uniformity of the coating application also at changing contact pressures. In all of the aforesaid publications the doctor surface was very smooth. But from driven, cylindrical doctor bars it is known to provide an exact dosing possibility for the doctor by means of circumferential grooving.

The problem underlying the invention is to make it possible in the initially mentioned prior devices to also achieve in doctor bars with irregular cross section a good dosing possibility at extremely uniform coating application, by a specific shaping of the grooves.

SUMMARY OF THE INVENTION

The problem is inventionally solved through the features of the present invention. The doctor surface is of a grooved design with mutually parallel grooves, forming ribs that extend essentially crosswise or perpendicular to the longitudinal expanse of the doctor bar, and which have their nearest approach to the paper web, or backing element supporting the web, at a distance of maximally 6 mm, and preferably 4 mm, from the area where they terminate on the leaving side of the doctor surface. The ribs are fashioned in their terminal areas toward the leaving end of the doctor body with a gradually decreasing width measured crosswise to the extension of the grooves, whereas they are no longer present in an area of 0 to 10 mm, preferably 0 to 6 mm, before the leaving edge.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplification set out herein illustrates one preferred embodiment of the invention, in one form, and such exemplifications are not to be construed as limiting the scope of the invention in any manner.

DESCRIPTION OF THE PREFERRED EMBODIMENT

Figure 1:
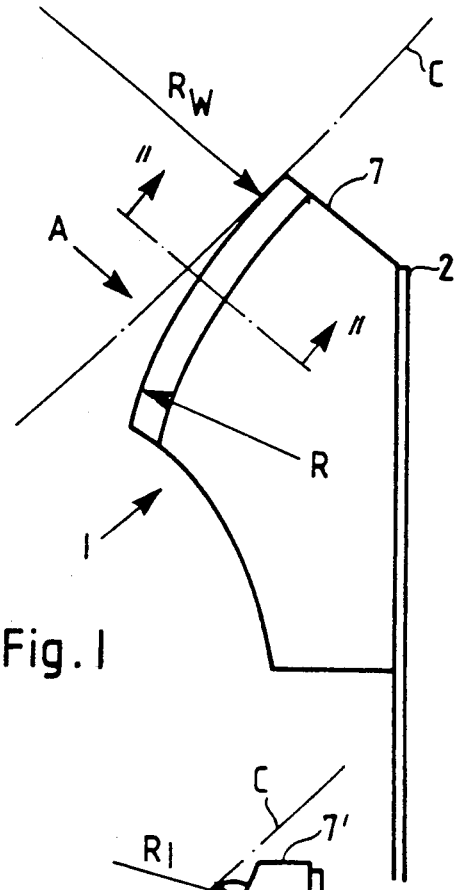
FIG. 1 shows a cross section of an inventional doctor bar.
Figure 4:
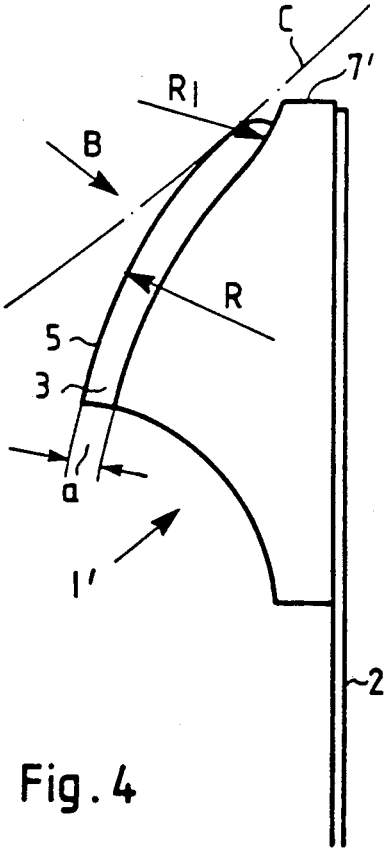
FIG. 4 is a cross sectional view of another embodiment of an inventional doctor bar corresponding to FIG. 1.

In FIG. 1, the doctor bar 1 is shown in a customary manner with round doctor bars installed in doctor beds. Bar 1 is supported by a holder blade or holder leaf spring 2. It can be forced down on the backing roll C, and thus on the paper or cardboard web supported by it, indicated by dash-dot line, by a pressure bar or other pressure means, which approximately in this indicated area acts on the doctor bar or on the leaf spring. In this figure, the radius of the backing roll C is marked $R_w$ while the radius of curvature of the bow-shaped doctor surface is signified as R. Thus, as shown, the curved surface of radius R is opposite the surface of backing roll C. $R_1$ is the radius at the leaving end of this curved surface, for a curve of that surface opposite to the curved shape of the doctor with the radius R, as shown in FIG. 4. $R_2$ is the radius at which the side surfaces of the ribs 4 approach until their disappearance on the leaving end.

Figure 3:
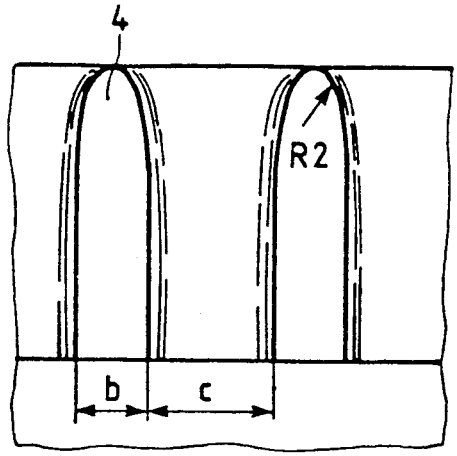
FIG. 3 is a view in the direction of arrow A in FIG. 1.
Figure 2:
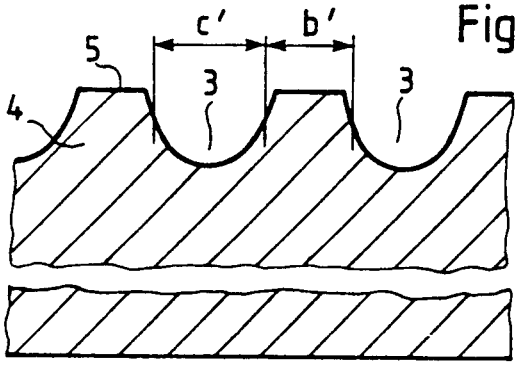
FIG. 2 is a longitudinal sectional view in the direction of arrows 11—11 in FIG. 1.

According to FIG. 2, the doctor surface consists entirely of juxtaposed grooves 3 between which ribs 4 are located. The ribs end in this case in a flat roof surface 5 having a width b. According to FIG. 3, these ribs become narrower toward the leaving edge 7 of the doctor bar 1, where their expanse equals zero, i.e., they disappear. A rounding radius $R_2$ is provided for that purpose. As can be seen from FIG. 3, the grooves 3 flatten out toward the leaving edge, a value between 10 and 25% of the normal height of the ribs 4 being provided for that purpose. Rounding radius $R_1$ approximately amounts to between 3 and 30 mm, and R1 may generally amount to between 10 and 35% of the rounding radius R of the doctor surface, or between 5 and 30% of the diameter of the backing roll toward the point of its shortest distance from the paper web or its guide element C. The groove width c is to have a specific ratio to the width of the ribs b, specifically b/c =0.3 to 0.8. In case the ribs 4 are not flattened by a roof surface 5, the referenced values and ratios apply in a section at two-thirds of the rib height. The absolute values for the rib height (or groove depth or height of the root surface) a amount to 0.3 to 3 mm, and 10 for the rib width b to 0.4 to 8 mm. The ratio of the width b of the roof surface to the groove depth a ranges from 1 to 2.5. A technology is desirable which allows lower limit values of .1 mm. The same dimensional ranges apply also the corresponding groove width c.

The radius R of the doctor surface may amount to at least 0.02 times, and preferably between 0.1 and 0.2 times, the radius $R_W$ of the backing roll C supporting the paper or cardboard web.

It is preferable for the leaving edge 7 of the doctor to be located at a distance between 0 and 10 mm, preferably between 0 and 6 mm, from the nearest point of the doctor surface relative to the paper web or the guide element C supporting it.

As a result of the selected shape of the groove it is assured that a uniform coating application will be generated transverse across the paper, that is, viewed along the web width.

Figure 5:
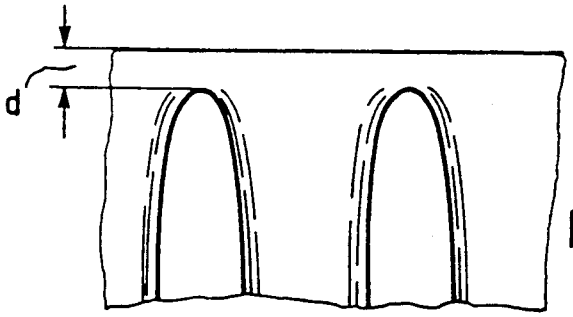
FIG. 5 is a view relating to FIG. 4 and corresponding to reference "B" in FIG. 4.

In FIGS. 4 and 5, it is shown that the ribs 3 terminate at the contact point or at the point of the least distance from the backing roll C. But the leaving edge 7' of the doctor bar 1' ends behind it, in the running direction of the web, by a value d = 1 to 4 mm. Here as well, as in the case of FIG. 3, the grooves 3 have at their end, in the area of the leaving edge 7', a considerably wider design, and the leaving edge 7' causes a uniform smoothing of the coating.

The rounding radius $R_1$ at which the grooves flatten from their bottom to the leaving edge 7' extends up to the latter.

It is preferable for the leaving edge 7' of the doctor surface to follow 0 to 3 mm after the end of the ribs 4.

Figure 6:
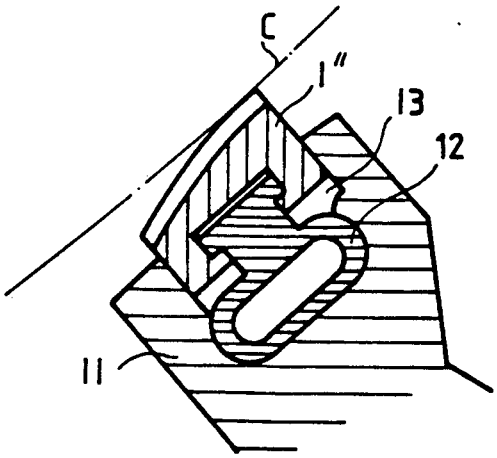
FIG. 6 is another way of mounting the inventional doctor bar.

According to FIG. 6, the doctor bar 1'' is installed in the groove of a compact doctor holder 11. A pressure hose 12 is provided for forcing the doctor bar down on the backing roll C.

Due to the overhang of the leaving edge 7 or 7' relative to the point of the doctor surface that is nearest the web or the backing roll C it is possible to achieve a control of the coating substance dosing. A doctor with a grooved surface is a dosing coating element with which a relatively exactly dosed amount can be applied on the paper web. The overhang makes it possible, through swiveling the bent doctor surface formed by the ribs and grooves, to somewhat compensate for the rib wear, which cannot be entirely avoided either with ceramic-coated grooves. This compensation option is amplified further by the rounding radius $R_1$.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In combination with a backing roll and a running web supported by said backing roll, a doctor for dosing a coating on the surface of said web, said doctor comprising:

a doctor body having a doctor surface, said doctor body being fashioned as a bar having a longitudinal surface, said bar having an irregular cross section perpendicular to said longitudinal surface and further having a sharp leaving edge, said doctor surface being rounded so that its distance from the web essentially diminishes continuously in the running direction of the web, said doctor surface being of a grooved design having mutually parallel grooves whereby ribs extending generally crosswise to the longitudinal surface of said bar are formed therebetween, wherein said ribs terminate at an area on the leaving edge of said doctor surface and have their nearest approach to said web at a maximum distance of 6 mm from said area of termination, said ribs having a gradually decreasing width measured crosswise to said grooves in said area of termination on said leaving edge so that said grooves are no longer present in an area of 0 to 10 mm before said leaving edge.

2. The combination according to claim 1, wherein a section along the longitudinal axis of t he doctor bar having the doctor surface includes flattened rib surfaces.

3. The combination according to claim 2, wherein said ribs narrow in width toward the leaving edge at a distance of 0 to 6 mm from the contact point of the doctor surface relative to said web.

4. The combination according to claim 1, wherein said leaving edge of the doctor is located a distance between 0 to 10 mm from the contact point of the doctor surface relative to said web.

5. The combination according to claim 1, wherein said grooves flatten out in bow-shaped fashion from the respective bottoms of said grooves toward said leaving edge by 10 to 25% of their overall height, with a rounding radius between 10 and 35% of the rounding radius of the doctor surface, or between 5 and 30% of the diameter of the backing roll toward the point of the minimum distance of said roll from said web.

6. The combination according to claim 1, in which the ribs have a flat roof surface wherein the ratio of the width b of said roof surface to the width c of the space between adjacent ribs b/c ranges from 0.3 to 0.8.

7. The combination according to claim 1, wherein the ratio of the width b of the ribs, measured at two-thirds of the height of the ribs, to the width c of the space between adjacent ribs b/c ranges from 0.3 to 0.8.

8. The combination according to claim 1, in which the ribs have a flat roof surface wherein the ratio of the width b of said roof surface to the groove depth a ranges from between 1 and 2.5

9. The combination according to claim 1, wherein the radius of the doctor surface ranges from at least 0.02 times the radius of the backing roll.

10. The combination according to claim 9, wherein the radius of the doctor surface ranges from 0.1 to 0.2 times the radius of the backing roll.

11. The combination according to claim 1, wherein the depth of the grooves ranges from between 0.3 and 3 mm.

12. The combination according to claim 1, in which the ribs have a flat roof surface, wherein the depth of the grooves and the height of said roof surface ranges from between 0.3 and 3 mm.

13. The combination according to claim 1, wherein the depth of the grooves, and the height of the ribs, measured at two-thirds the rib height, ranges from between 0.3 and 3 mm.

14. The combination according to claim 5, wherein the leaving edge of the doctor surface follows 1 to 4 mm after the end of the ribs, and the rounding radius at which the ribs flatten out from their bottom essentially continues up to said leaving edge.

15. The combination according to claim 1, wherein at least the surface of the doctor body consists of a ceramic, hard and wear-resistant layer.

16. The combination according to claim 1, wherein said doctor body consists of ceramic oxide material.

17. The combination according to claim 1, wherein the ratio of the width b of said rib to the groove depth a, measured at two-thirds of the height of the ribs, ranges from between 1 and 2.5.

* * * * *